US006085702A

United States Patent [19]

Ito

[11] Patent Number: 6,085,702

[45] Date of Patent: Jul. 11, 2000

[54] LUBRICATION SYSTEM FOR AN ENGINE HAVING A FLOATLESS CARBURETOR

[75] Inventor: Kazumasa Ito, Iwata, Japan

[73] Assignee: Yamaha Hatsudoki Kabushiki Kaisha, Shizuoka-ken, Japan

[21] Appl. No.: 09/046,661

[22] Filed: Mar. 23, 1998

[30] Foreign Application Priority Data

Mar. 21, 1997 [JP] Japan ..... 9-087674

[51] Int. Cl.[7] ..... F01M 33/00

[52] U.S. Cl. ..... 123/73 AD

[58] Field of Search ..... 123/73 AD, 337; 251/305

[56] References Cited

U.S. PATENT DOCUMENTS

| | | | |
|---|---|---|---|
| 3,447,519 | 6/1969 | Marcik et al. | 123/73 AD |
| 3,545,417 | 12/1970 | Yamamoto | 123/73 AD |
| 3,653,784 | 4/1972 | Leitermann et al. | 417/317 |
| 3,913,551 | 10/1975 | Shaver | 123/198 DB |
| 4,383,504 | 5/1983 | Walsworth | 123/73 AD |
| 4,539,949 | 9/1985 | Walsworth | 123/73 AD |
| 4,551,076 | 11/1985 | DuBois | 417/395 |
| 4,552,101 | 11/1985 | Borst et al. | 123/73 AD |
| 4,555,221 | 11/1985 | DuBois | 417/349 |
| 4,573,932 | 3/1986 | DuBois | 440/88 |
| 4,583,500 | 4/1986 | Hundertmark | 123/73 AD |
| 4,928,390 | 5/1990 | Gassen et al. | 30/123.4 |
| 4,966,105 | 10/1990 | Mori | 123/73 AD |
| 5,195,481 | 3/1993 | Oyama et al. . | |
| 5,570,661 | 11/1996 | Nakamura et al. . | |
| 5,701,856 | 12/1997 | Nagano et al. | 123/73 AD |
| 5,732,672 | 3/1998 | Nakase . | |
| 5,794,593 | 8/1998 | Sugii | 123/438 |

*Primary Examiner*—Noah P. Kamen
*Assistant Examiner*—Hai Huynh
*Attorney, Agent, or Firm*—Knobbe, Martens, Olson & Bear LLP

[57] ABSTRACT

A lubrication system for an engine having a fuel system including a floatless carburetor is disclosed. The engine has an intake system through which air is supplied to the engine, the carburetor associated with the intake system and arranged to deliver fuel into air passing through an air flow passage therethrough. The carburetor has a main fuel supply line extending between a fuel supply chamber and a discharge to the air flow passage, a first one-way type valve arranged along the main fuel supply line, a diaphragm dividing the fuel supply chamber from an air chamber, the air chamber coupled to an air source whereby movement of the diaphragm causes fuel to be discharged through the main fuel supply line to the air passage. The lubrication system is arranged to deliver lubricant from a supply through a lubricant supply line communicating with the main fuel supply line between the first one-way type valve and the discharge.

25 Claims, 12 Drawing Sheets

LUBRICATION SYSTEM FOR AN ENGINE HAVING A FLOATLESS CARBURETOR

FIELD OF THE INVENTION

The present invention relates to a lubrication system for an engine powering a watercraft. More particularly, the invention is an arrangement for introducing lubricant to an engine through a floatless carburetor of a fuel system for such an engine.

BACKGROUND OF THE INVENTION

Personal watercraft generally include a water propulsion device which is powered by an internal combustion engine. These watercraft are generally quite small in size, often limited to use by a single person.

The engine of the watercraft is positioned in an enclosed engine compartment defined by a hull of the watercraft. Due to the small size of the watercraft, the engine compartment is very small, and thus the engine is arranged in fairly compact fashion therein.

To avoid the need for a complex lubrication system, which contributes to a larger engine size and cost, in many cases lubricant is supplied to the engine along with the fuel. This is a very common arrangement for internal combustion engines operating on two-cycle principle. For example, lubricant may be pumped from an oil tank into the fuel tank for mixing with the fuel, with the combined mixture then delivered to the engine.

In some instances, the fuel is supplied to air passing through an intake system with a floatless carburetor. The floatless carburetor typically has a fuel chamber separated from an atmospheric chamber by a diaphragm. The fuel chamber is typically filled by fuel supplied through a fuel pump. The fuel is then supplied from the fuel chamber to a venturi. The venturi introduces fuel into the airstream and allows the mixing of the fuel and air within the carburetor.

A mixture of lubricant and fuel can be delivered with such a carburetor. A problem with this arrangement, however, is that it is difficult to control the rate at which lubricant is delivered to the engine at a given time since it is mixed with a large quantity of fuel. At the same time, attempts to provide lubricant in other manners must not interfere with the operation of the carburetor's main function, that of delivering fuel.

Accordingly, it is desired to have a lubrication system wherein the lubricant flow rate to the engine can be more accurately controlled based on engine conditions. It is also desired for such a lubrication system where the lubricant is introduced into the fuel stream and mixed with the fuel being supplied by a floatless carburetor, while at the same time ensuring that the lubricant delivery does not interrupt the proper operation of the carburetor.

SUMMARY OF THE INVENTION

A lubrication system for an engine having a fuel system including a floatless carburetor is disclosed. The engine has an intake system through which air is supplied to the engine, the carburetor associated with the intake system and arranged to deliver fuel into air passing through an air flow passage therethrough.

This type of carburetor has a main fuel supply line extending between a fuel supply chamber and a discharge to the air flow passage, a first one-way type valve arranged along the main fuel supply line, a diaphragm dividing the fuel supply chamber from an air chamber, the air chamber coupled to an air source whereby movement of the diaphragm causes fuel to be discharged through the main fuel supply line to the air passage.

In accordance with the present invention, the lubrication system is arranged to deliver lubricant from a supply through a lubricant supply line communicating with the main fuel supply line between the first one-way type valve and the discharge.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention relates generally to a lubrication system for an engine, the lubrication system arranged to deliver lubricant to the engine via a floatless carburetor of a fuel system of the engine. Preferably, the engine is of the type utilized to power a watercraft, and more particularly, a personal watercraft, as this is an application for which the present lubrication system has particular advantages. It should be understood, however, that the lubrication system may be used in other applications.

Figure 1:
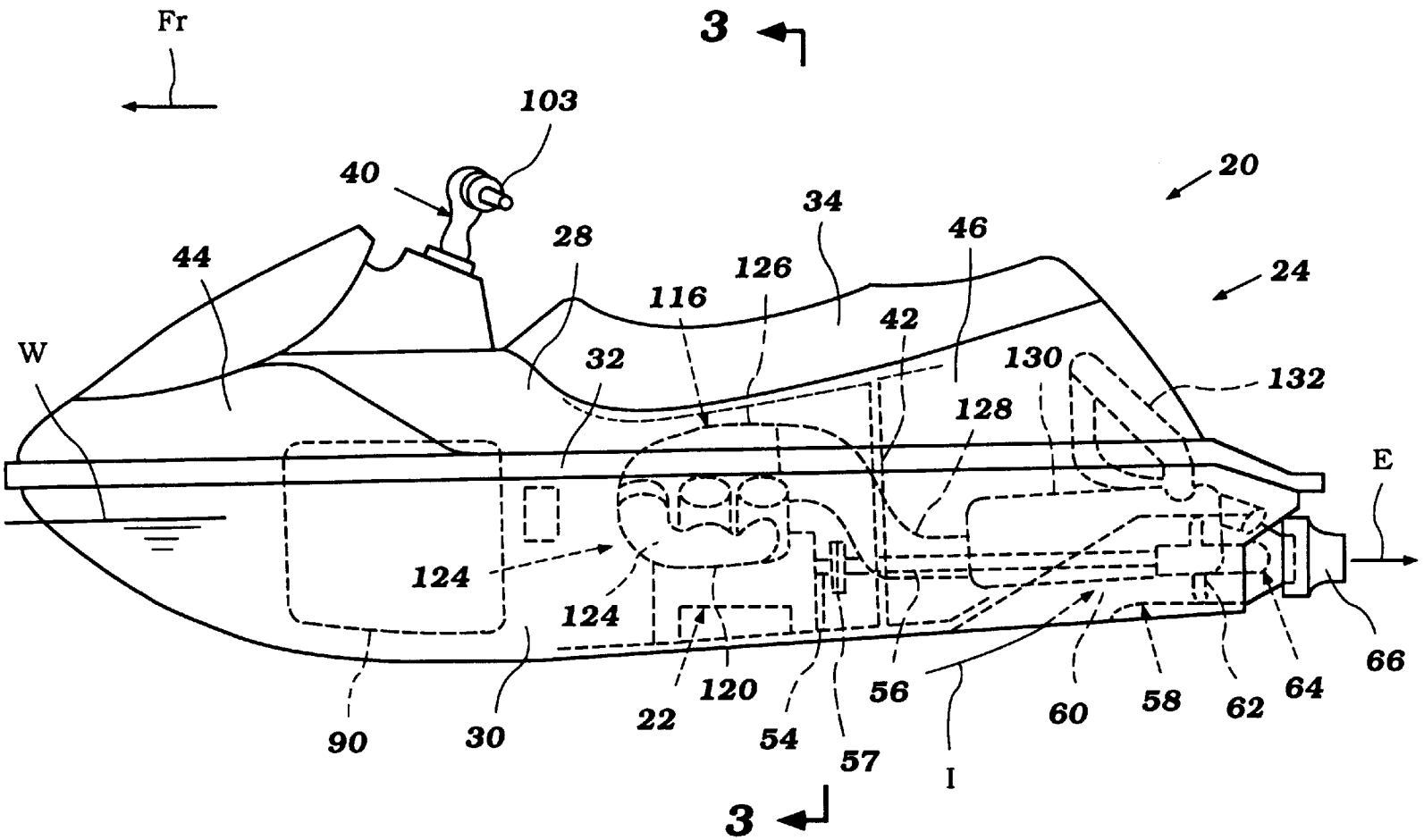
FIG. 1 is a side elevational view of a personal watercraft of the type powered by an engine having a lubrication system in accordance with the present invention, the engine and other watercraft components positioned within a hull of the watercraft illustrated in phantom.
Figure 2:
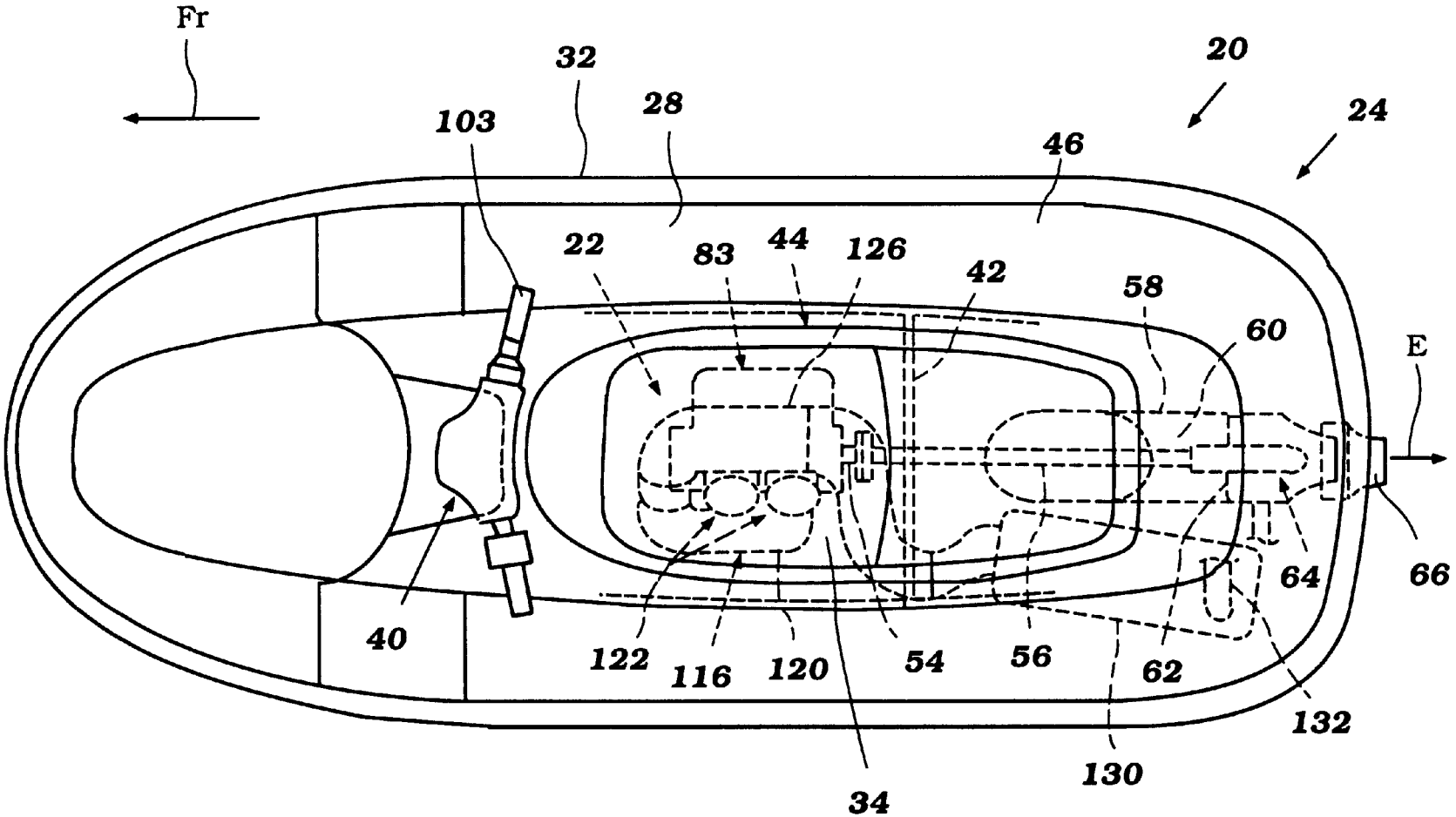
FIG. 2 is a top plan view of the watercraft illustrated in FIG. 1, with the engine and other watercraft components positioned within the hull of the watercraft illustrated in phantom.
Figure 3:
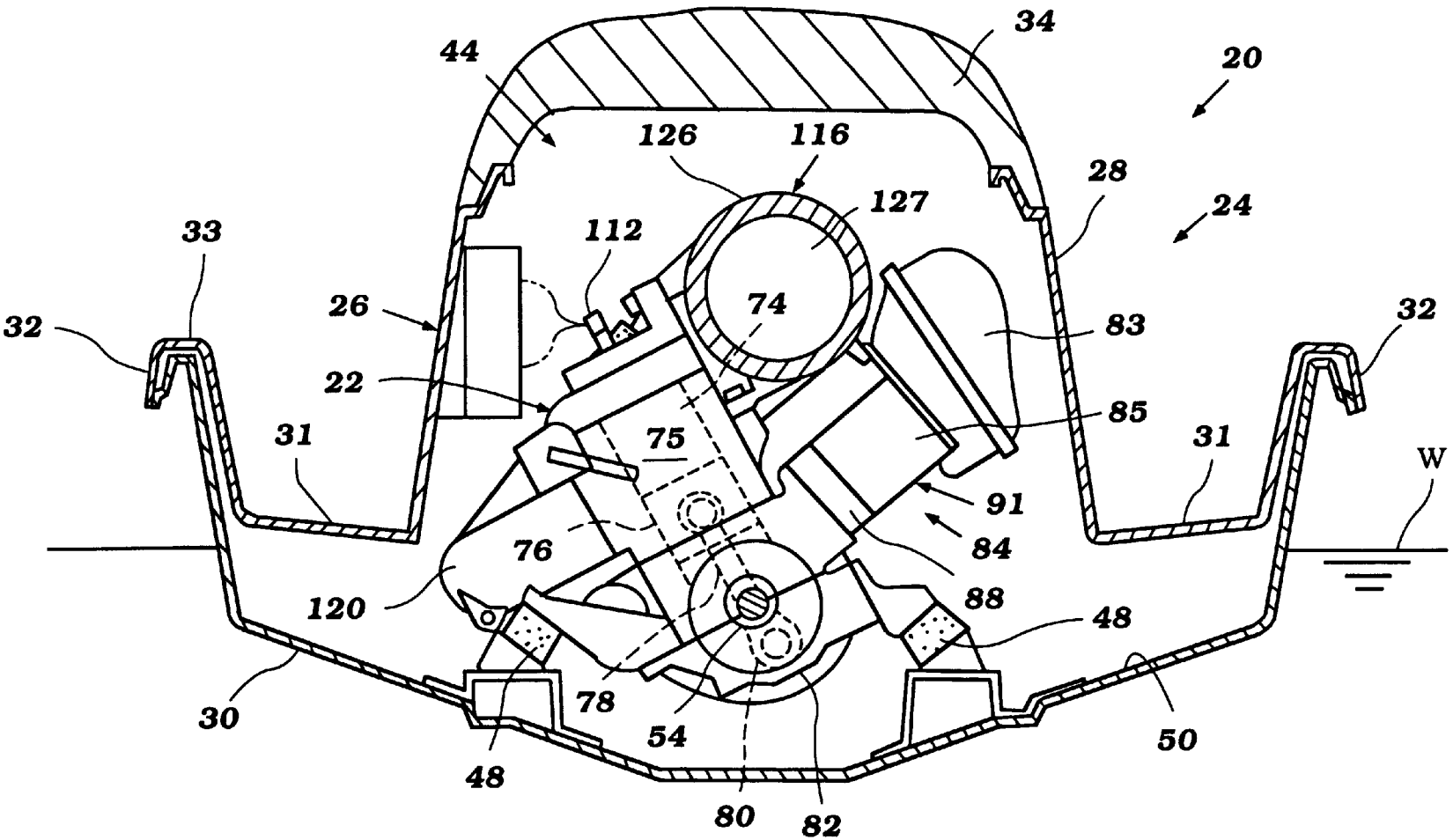
FIG. 3 is an front elevational view, in partial cross-section, of the watercraft illustrated in FIG. 1.

FIGS. 1–3 illustrate a watercraft 20 having a watercraft body 24. The body 24 has a hull 26 generally comprised of an upper portion, or deck, 28 and a lower portion 30. A gunnel 32 defines the intersection of the deck 28 and the lower portion 30.

A seat 34 is positioned on the top portion 28 of the hull 26. The seat 34 may be removably connected to a portion of the hull to provide access to an engine compartment within the hull 26. A steering handle 40 is provided adjacent the seat 32. A user directs the motion of the watercraft 20 with the steering handle. A step 31 is provided between the seat 34 and a bulwark 33 defined on each side of the watercraft 20, as illustrated in FIG. 3.

The upper and lower portions 28, 30 of the hull 26, along with a bulkhead 42, define an engine compartment 44 and a pumping chamber 46. The engine 22 is positioned in the engine compartment 44. As best illustrated in FIG. 3, several engine brackets 49 connect the engine 22 to the hull 26. The engine brackets 49 are connected to a bottom 50 of the lower portion 30 of the hull 26 through resilient engine mounts 48. Preferably, the engine mounts 48 include at least one section comprising a material for damping vibration transmission between the hull 26 and engine 22. The engine 22 is preferably partially accessible through a maintenance opening. As mentioned above, the engine is desirably accessible by removing a removable deck member on which the seat 34 is mounted.

The engine 22 has a crankshaft 54 which drives an impeller shaft 56. The crankshaft 54 preferably extends along a centerline through the watercraft 20 from front to rear. With reference to FIG. 1, an end of the crankshaft 54 extends from the engine to a coupling 57. The coupling connects the crankshaft 54 to an end of the impeller shaft 56. The impeller shaft 56 rotatably powers a means for propelling water. The illustrated propulsion means is a propulsion unit 58 which expels or moves water rearwardly from the watercraft 20. The expulsion of the water propels the watercraft 20 in a generally forward direction Fr.

The propulsion unit 58 includes a propulsion passage 60 having an intake port which extends through the lower portion 30 of the hull 26. Water ("W" in FIG. 1) is drawn through the propulsion passage 60 in the direction I. An impeller 62 is rotatably driven by the impeller shaft 56. The impeller 62 is positioned in the passage 60. The passage 60 has an outlet 64 positioned within a nozzle 66. The nozzle 66 is mounted for movement up, down, left and right. Accordingly, the nozzle expels water in a direction E under force, whereby the direction of the propulsion force for the watercraft 20 may be varied.

Figure 4:
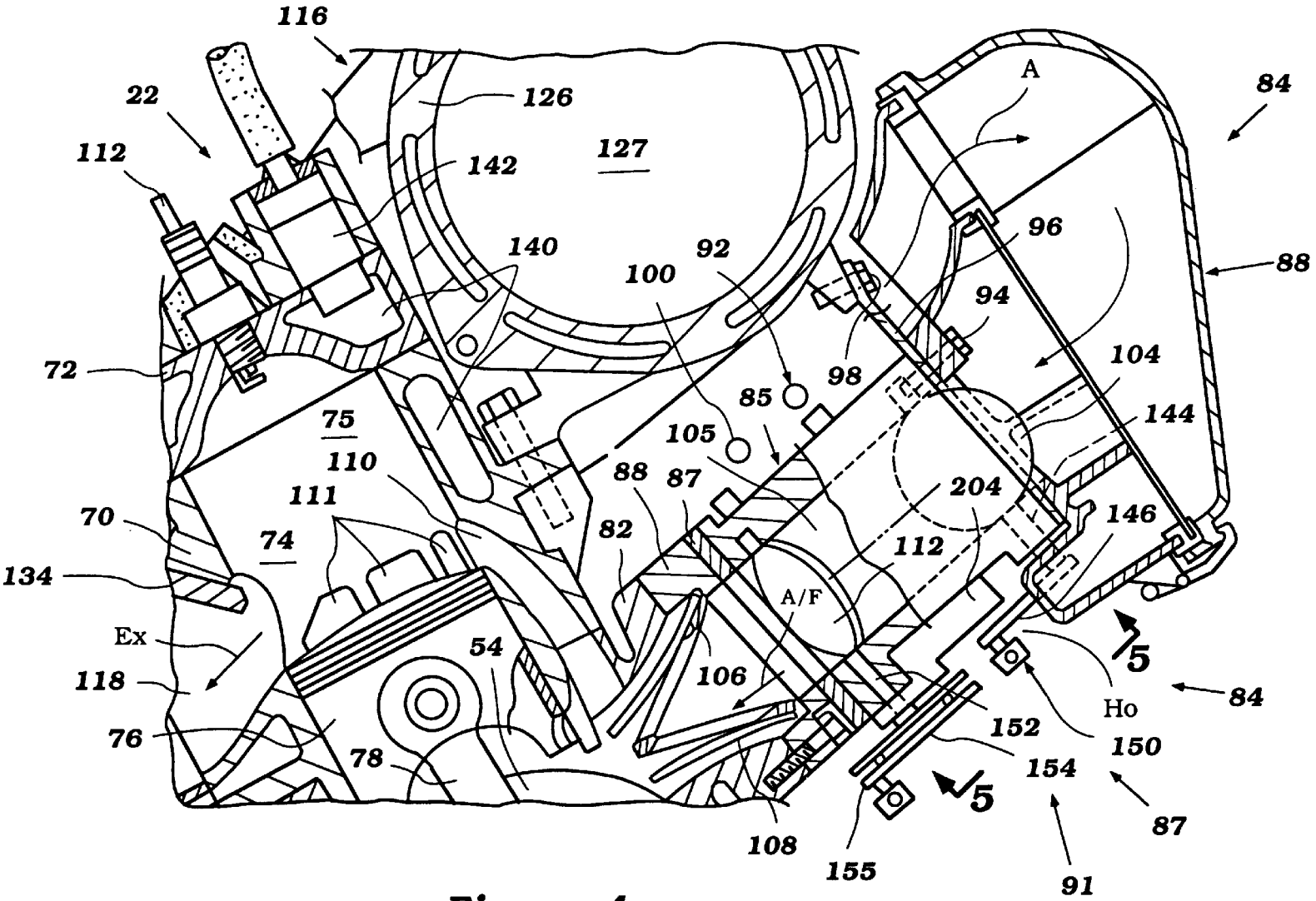
FIG. 4 is a cross-sectional end view of a portion of the engine illustrated in FIG. 1.

With reference primarily to FIG. 4, the engine 22 is preferably of the two-cylinder, two-cycle variety. Of course, the engine 22 may have as few as one, or more than two, cylinders, as may be appreciated by one skilled in the art. In addition, the engine may operate on a four-cycle or other operating principle.

The engine 22 has a cylinder block 70. A cylinder head 72 is connected to the cylinder block 70. Two cylinders 74 are within the cylinder block 70 by a cylinder wall and a recessed area in the cylinder head 72. A portion of each cylinder located above a head of a piston 76 serves as a combustion chamber 75. Each piston 76 is connected to the crankshaft 54 via a connecting rod 78, as is well known in the art.

With reference to FIG. 3, the crankshaft 54 is rotatably journalled within a crankcase chamber 80 by a number of sealed bearings. Preferably, a crankcase cover member 82, which extends from a bottom portion of the cylinder block 70, defines the chamber 80. As is well known, the crankshaft 54 has pin portions extending between web portions thereof, with each connecting rod 78 connected to one of the pin portions and the web portions rotatably supported by the bearings mounted to members extending from the block 70 and cover 82.

As best illustrated in FIGS. 3 and 4, the engine 22 includes means for providing an air and fuel mixture to each combustion chamber 75. Preferably, air is drawn into the engine compartment 44 through one or more air inlets in the hull 26. Air is then drawn through an intake system 84 including an intake or air box 83, a passage 105 defined by a body 85 of a carburetor 91 and a passage 86 through an intake manifold 88 leading into the crankcase chamber 80 of the engine 22.

As illustrated, one or more fasteners 94 connect the air box 83 to a first end of the carburetor 91. A mounting plate 96, arranged between the carburetor body 85 and air box 83, is connected to the cylinder block 70 with one or fasteners 98. Thus the air box 83 and the carburetor 91 are securely mounted together.

The end of the carburetor 91 opposite the air box 83 is mounted to the intake manifold 88 via a coupling plate 87. One or more fasteners then join the intake manifold 88 to the crankcase cover 82 portion of the engine 22.

An air/fuel charge is provided to each cylinder 74 for combustion. Preferably, fuel is combined with the incoming air passing through the passage 105 of the carburetor 91. In particular, fuel is drawn from a fuel tank 90 (see FIG. 1) positioned in the engine compartment 44 by a fuel pump (not shown) and delivered through a fuel delivery line 92 to a charge former, which in this case is the carburetor 91. Fuel which is delivered to the carburetor 91, but not delivered to the air flowing therethrough, may be returned to the fuel tank 90 through a return line 100.

With reference to FIG. 4, a throttle valve 102 and a choke valve 104 are rotatably mounted in the passage 105 for allowing the watercraft operator to control the rate of fuel and air delivery to the engine 22. By using a throttle linkage and choke linkage of the carburetor 91, the operator controls the speed and power output of the engine. Preferably, the throttle valve 102 is adjustable through a cable communicating with a throttle control 103 positioned on the steering handle 40 of the watercraft 20. The details of the carburetor 91, the throttle valve 102 and choke valve 104 will be described in more detail below.

The air and fuel mixture (labeled A/F in FIG. 4) selectively passes through an intake port 106 into the crankcase chamber 80. The flow is controlled by a reed valve 108, as is known in the art. As is also well known, each cylinder 74 has a corresponding intake port 106 and a corresponding reed valve 108. Accordingly, the crankcase chamber 80 is compartmentalized so as to provide a crankcase compression feature for each combustion chamber. The air and fuel charge contained within the crankcase chamber 80 is delivered to its respective combustion chamber 75 through at least one scavenge passage 110 leading to one or more scavenge ports 111 in the cylinder wall.

A suitable ignition system ignites the air and fuel mixture provided to each combustion chamber. Preferably, this ignition system comprises a spark plug 112 having its electrode tip positioned in the combustion chamber 75. The ignition system fires each spark plug in a predetermined sequence.

Though not illustrated, the engine 22 may include a flywheel connected to one end of the crankshaft 54. The flywheel has a number of magnets thereon for use in a pulsar-coil arrangement. The pulsar-coil generates firing signals which the ignition system uses to control the timing and sequence of spark plug firing. In addition, the ignition system may include a battery. The battery provides power to an electric starter and other electrical features of the watercraft. In addition, a number of teeth may be mounted on the periphery of the flywheel for use in starting the engine 22 with a starter motor (not illustrated).

The engine 22 also includes a lubrication system for providing lubricating oil to the various moving parts thereof. Preferably, the lubrication system includes an oil tank or reservoir (not shown) from which lubricating oil is delivered to and circulated throughout the engine.

Referring to FIGS. 1, 2 and 4, exhaust gas (labeled "Ex" in FIG. 4) generated by the engine 22 is routed from the engine to a point external to the watercraft 20 by an exhaust system 116. The exhaust system 116 includes an exhaust passage 118. The exhaust passage 118 leads from each combustion chamber 74 through the cylinder block 70. An exhaust manifold 120 is connected to a side of the engine 22. The manifold 120 has two branch portions 122 each having a passage therethrough. The manifold passages communicate with the passages 118 leading through the cylinder block 70. Exhaust generated in each combustion chamber 75 is thus routed through a respective passage 118 into a branch 122 of the manifold 120.

The passages through each branch 122 of the manifold 120 merge into a single pipe part 124 having a passage 125 therethrough. The pipe part 124 leads to an exhaust chamber 126. The exhaust chamber 126 has a passage 127 therethrough which preferably includes an enlarged part or chamber through which exhaust routed.

Exhaust flows from the passage 127 of the exhaust chamber 126 into an upper exhaust pipe 128. The upper exhaust pipe 128 preferably narrows to a smaller diameter from the enlarged exhaust chamber 126. The upper exhaust pipe 128 routes exhaust to a water lock 130. The upper exhaust pipe 128 is preferably connected to the water lock 130 via a flexible fitting, such as a rubber sleeve. The exhaust flows through the water lock 130, which is preferably arranged as known to those skilled in the art, and then passes to a lower exhaust pipe 132 which has its terminus in the propulsion passage. In this manner, exhaust flows from the engine 22 through the exhaust system to its discharge within the water flowing through the passage 60. A catalyst (not shown) may be positioned within the exhaust system 116 for catalyzing the exhaust gases.

Means are preferably provided for controlling the flow of exhaust gases through the exhaust passages 118 from combustion chamber 75. This means comprises a sliding-knife type valve 134, but may comprise a rotating or other type valve, and means for moving the valve, as well known to those skilled in the art.

Preferably, a cooling system is also provided for cooling the engine 22 and the associated exhaust system 116. Such cooling systems are well known to those of skill in the art and as such the cooling system is not described in detail herein. Preferably, the cooling system routes liquid coolant to one or more coolant jackets 140 associated with the engine 20 and exhaust system 116. A water temperature sensor 142 may be provided in the cylinder block 70 for measuring the coolant temperature.

The carburetor 91 will now be described in detail with reference to FIGS. 4–10. In general, the carburetor 91 is of the floatless variety, and includes an accelerating pump for providing an additional amount of fuel to the engine 20 over and above that provided by a main fuel delivery mechanism. As discussed in detail below, the carburetor is also associated with a lubrication system having features, aspects and advantages in accordance with the present invention.

Figure 5:
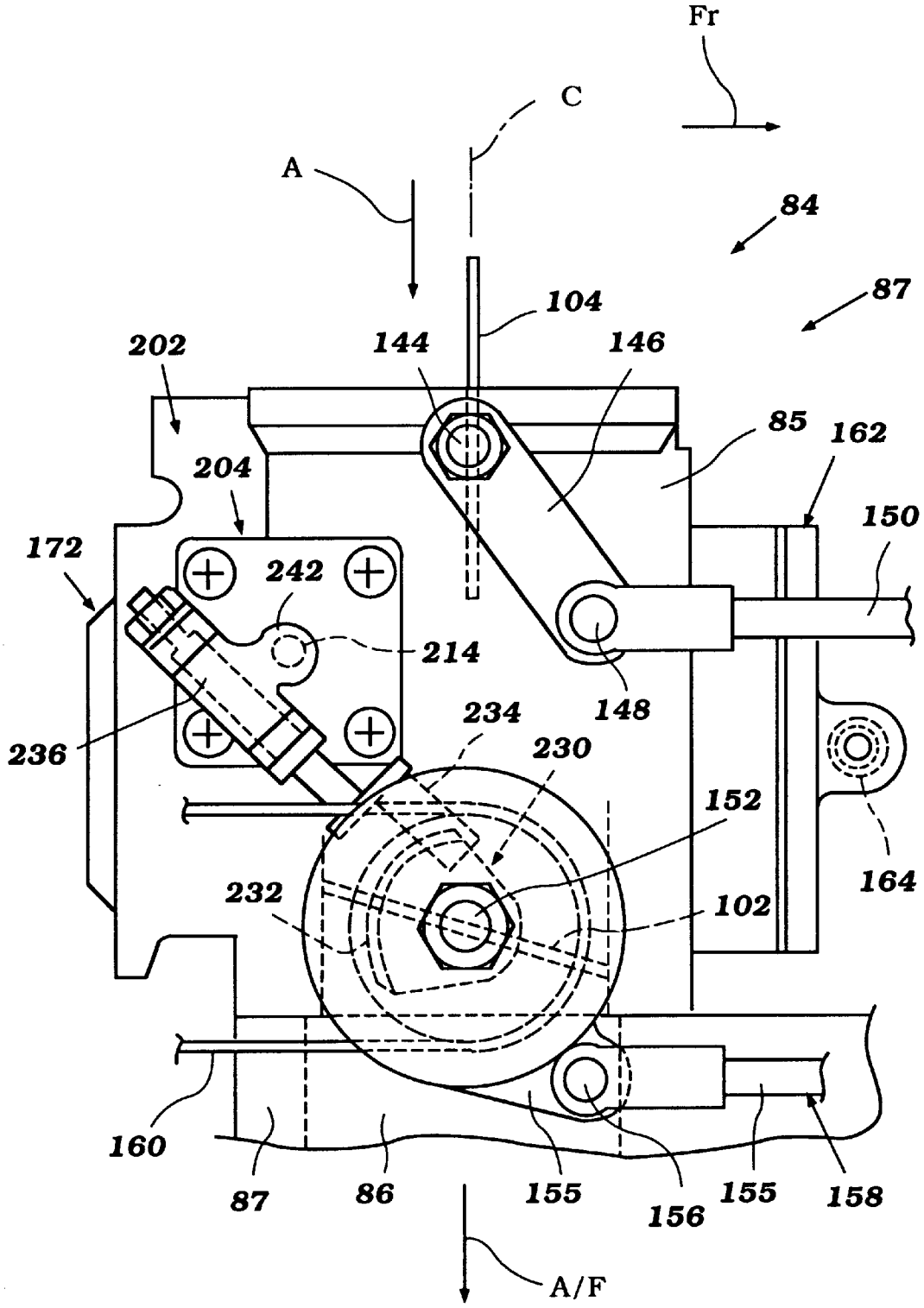
FIG. 5 is a side elevational view of a carburetor of the engine as viewed in the direction of line 5—5 in FIG. 4.

Referring primarily to FIGS. 4 and 5, the choke valve 104 comprises a plate which is mounted to a choke shaft 144. The choke shaft 144 is rotatably mounted within the body 85 of the carburetor 91. At least one end of the choke shaft 144 extends through the body 88. A first end of a choke lever 146 is connected to the end of the choke shaft 144 which extends outside of the body 85. As illustrated in FIG. 5, a second end of the choke lever 146 is rotatably connected to a choke linkage 150 by a pin 148. Though not shown, the choke valve lever 146 and the choke valve 104 are movable by a cable or similar control which is actuated by the control 103 (such as a throttle grip) at the steering handle 40.

Figure 7:
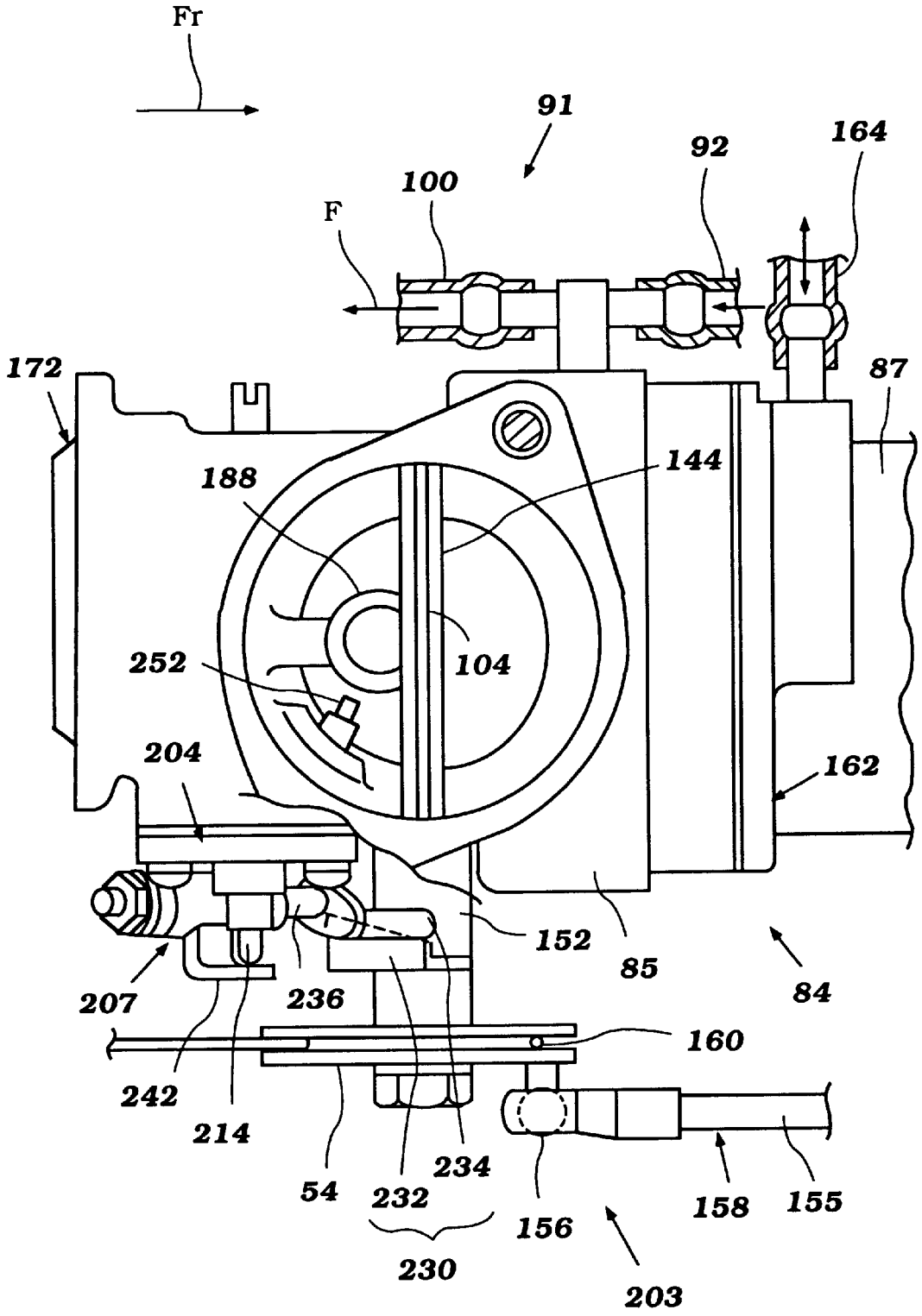
FIG. 7 is top view of the carburetor of the engine with an air box associated therewith removed.

Similarly, the throttle valve 102 comprises a plate which is mounted to a throttle shaft 152. The throttle shaft 152 is mounted for rotation with respect to the body 85 of the carburetor 91 and has an end which extends through the body 85. A first end of a throttle lever 154 is connected to an end of the throttle shaft 152 which extends beyond the body 85. The throttle lever as illustrated in FIGS. 5 and 7, is desirably a sheave, or similar structure, having a linkage arm portion 155. The linkage of the throttle lever 154 is rotatably connected to a throttle linkage 155 of an operating mechanism 158 via a pin 156. The throttle grip or control 103 at the steering handle 40 actuates the throttle lever 154 through a cable 160.

In the instant arrangement, a separate intake, and thus carburetor 91, is provided corresponding to each of the two cylinders 74 of the engine 20. Thus, both the throttle link 155 and the choke link 150 extend to a corresponding throttle lever and choke lever (not shown) of the carburetor for the other cylinder. In this fashion, rotation of the throttle lever 154 with the cable 160 effectuates rotation of the lever associated with the other carburetor via the linkage 155. As well known to those of skill in the art, a variety of other throttle and choke operating arrangements may be provided.

As illustrated in FIG. 5, the throttle shaft 152 and the choke shaft 144 desirably extend through a centerline C which extends through the passage 105 of the carburetor 91.

Figure 9:
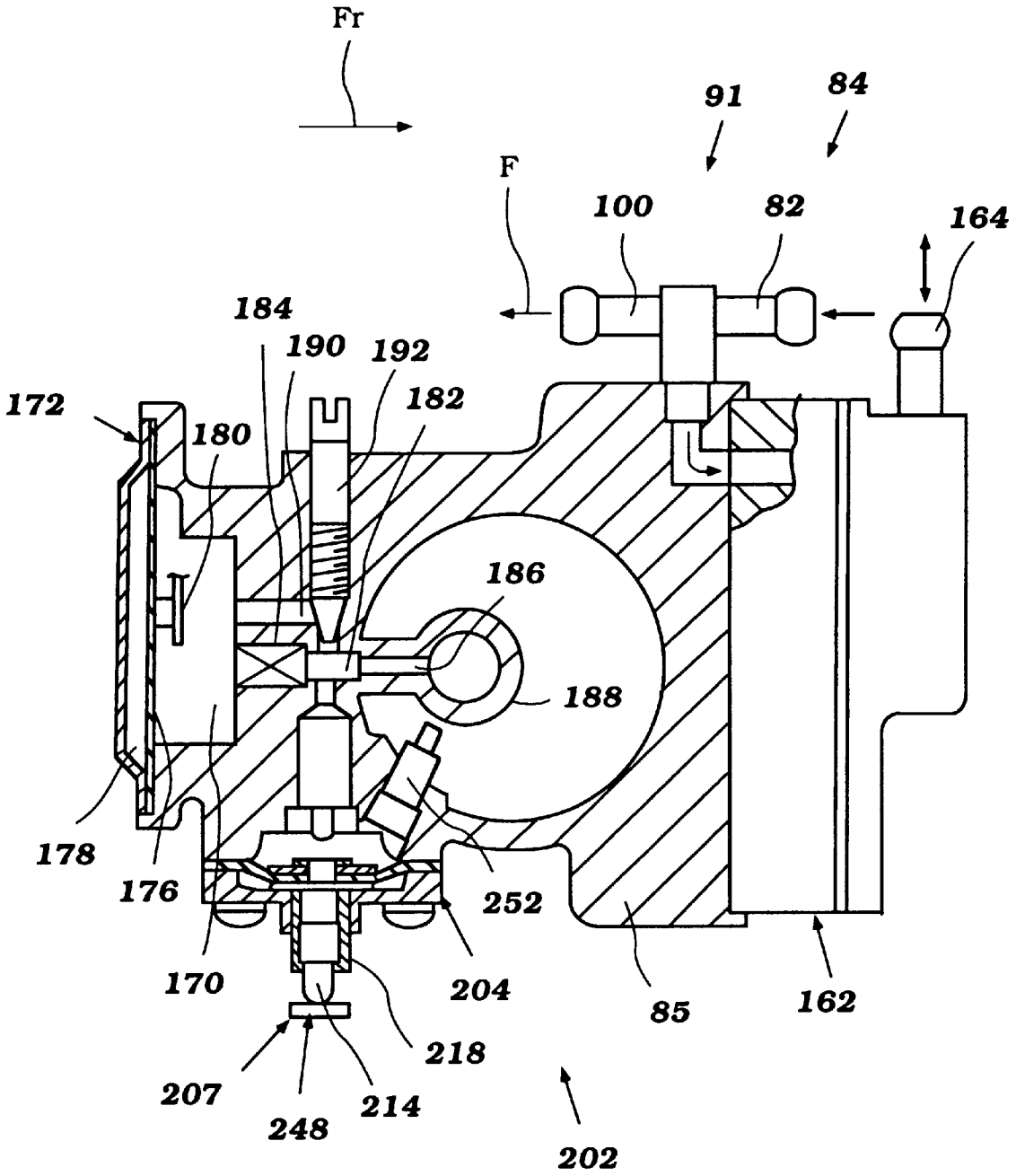
FIG. 9 is a cross-sectional view of the carburetor illustrated in FIG. 6 taken along line 8—8 therein.

A fuel pump 162 delivers fuel to the carburetor 91 through the fuel delivery line 92. In particular the fuel is pressurized and delivered into the air stream passing through the passage 105. The fuel pump 162 may be additional to the above-referenced pump which may be used to deliver fuel from the fuel tank 90 to the carburetor 91. With reference to FIG. 9, fuel is delivered through the supply line 92 to the pump 162. The pump 162 is preferably of the diaphragm operated or actuated type. As such, the pump 162 has a fuel chamber (not shown) on one side of a diaphragm (not shown) and an air chamber (not shown) on the opposite side of the diaphragm. Air pressure pulses are provided to the air chamber through a pipe 164. The pipe 164 may communicate with the crankcase or the like. As will be recognized by one skilled in the art, any of a variety of suitable pumps may alternatively be used.

Figure 8:
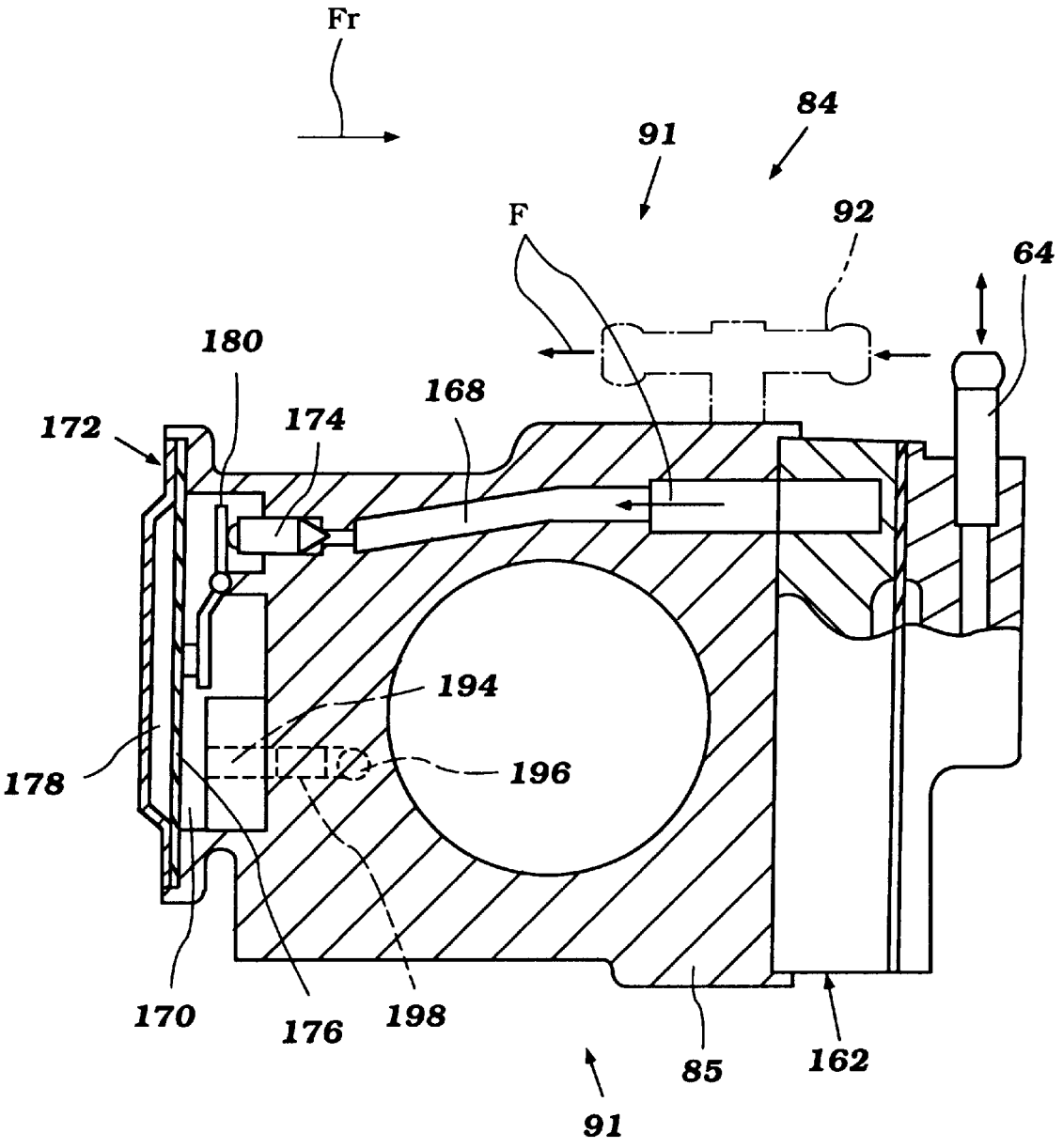
FIG. 8 is a cross-sectional view of the carburetor illustrated in FIG. 6 taken along line 8—8 therein.

With reference to FIG. 8, the fuel pump 162 supplies fuel to a fuel chamber 170 through a delivery passage 168. Preferably, the flow of fuel is governed by a fuel flow control mechanism 172. The control mechanism 172 has a diaphragm operated valve 174. As illustrated, the valve 174 is desirably a one-way type valve positioned along the delivery passage 168. The valve 174 is arranged to open and close dependent upon the movement of a diaphragm 176. In this arrangement, an atmospheric chamber 178 is provided on one side of the diaphragm 176, while the fuel chamber 176 is provided on the other. A lever member 180 connects the diaphragm 176 and the valve 174, whereby the valve 174 moves in response to movement of the diaphragm 176.

Figure 6:
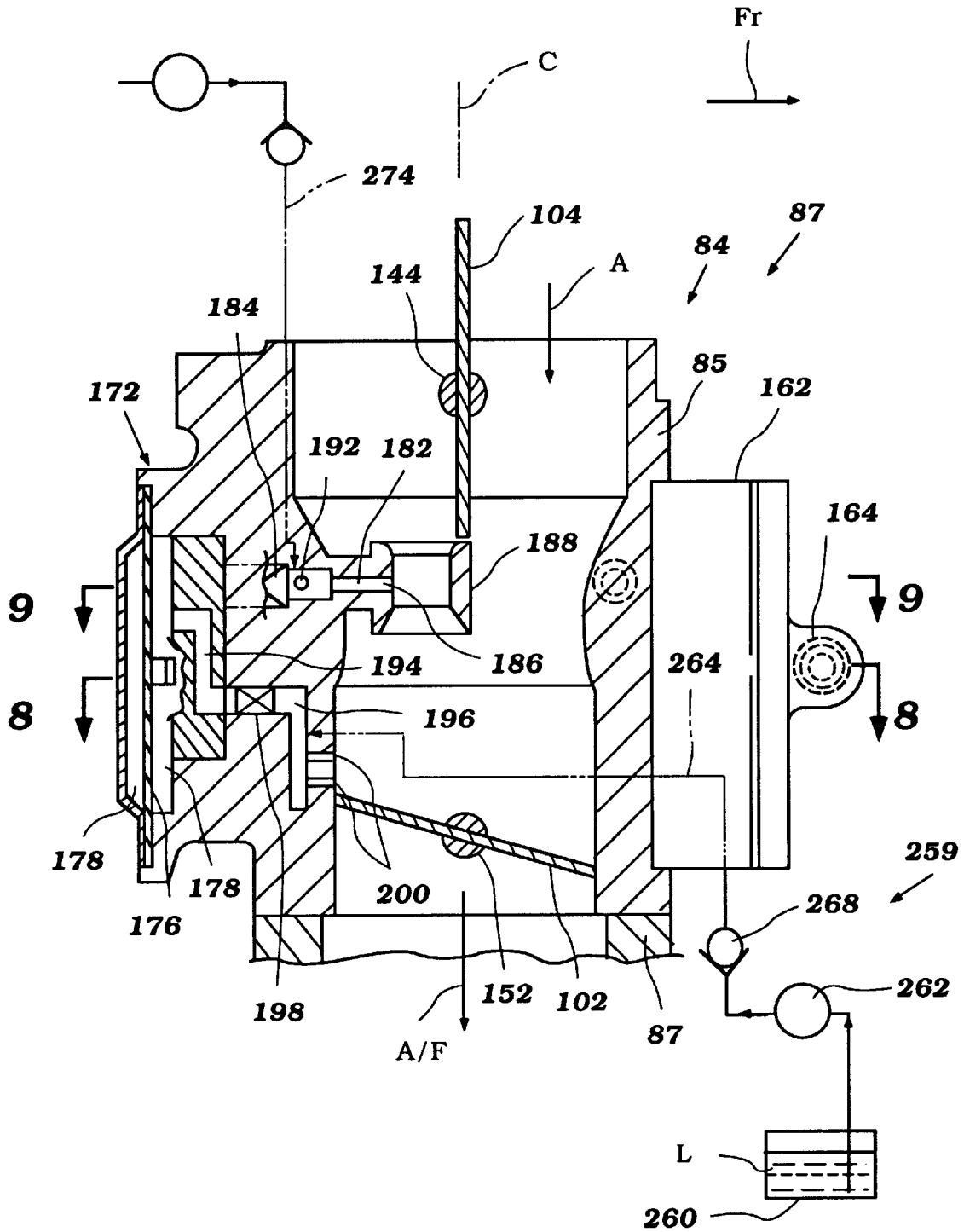
FIG. 6 is a cross-sectional view of the carburetor illustrated in FIG. 5 taken along a centerline C.

Referring to FIGS. 6 and 9, fuel fills the fuel chamber 170. The fuel is ultimately delivered to the air stream through a main supply passage 182. A valve 184 governs the fuel flow through the main supply passage 182. The valve 184 is preferably a one-way check valve preventing the reverse flow of fuel towards the chamber 170. The main passage 182 leads to a nozzle 186 positioned in a venturi member 188. The venturi member 188 is advantageously located in the passage 105 which extends through the body 85 of the carburetor 91.

Means are provided for adjusting the primary fuel supply. Preferably, this means comprises a secondary fuel passage 190 leading from the fuel chamber 170 to a point along the main passage 182 downstream of the one-way type valve 184. In addition, a means for controlling the flow rate of fuel through the secondary passage 190 is provided. The means for controlling the flow rate in the illustrated embodiment is a needle valve 192. As will be recognized by those skilled in the art, other means may include various flow governors, valve-type and restrictor members. With reference to FIG. 9, the needle valve 192 threadingly engages the body 85 of the carburetor 91 and is arranged to selectively open and close the secondary passage 190. An operator of the craft 20 may thus control the flow rate through the secondary passage 190, and thus the total flow rate of fuel supplied to the engine 22.

Generally, the rate at which fuel is supplied to the engine 22 is partially dependent upon the rate at which air flows through the passage 105, and thus the throttle valve angle. Of course, at idle the throttle valve 102 is generally closed, such that the fuel will generally not be pulled through the main passage 182.

With reference to FIG. 6, an idle fuel delivery mechanism is provided. The idler fuel delivery mechanism comprises an idle fuel supply passage 194. The idle fuel passage 194 extends generally downwardly from the fuel chamber 170 (from a point generally below the fuel level therein) to a connecting passage 196 in the body 85 of the carburetor 91. The connecting passage 196 extends to one or more idle supply ports 200 arranged in the wall of the air passage 105. Preferably, a one-way type valve 198 is provided in the passage 196 for preventing the back-flow of fuel into the chamber 170. Of course, the one-way valve may also be arranged within the idle fuel supply passage 194 or at the junction of the idle fuel supply passage 194 and the connecting passage 196.

As illustrated, the ports 200 are located upstream of the throttle valve 102. As such, one or more small air holes may be provided through the throttle valve 102 for providing an idle flow of air and fuel. Alternatively, the valve 102 may be prevented from completely closing. The ports 200 may also be provided downstream of the throttle valve 102.

A fuel increasing mechanism 202 is also associated with the carburetor 91. The fuel increasing mechanism 202 provides an additional amount of fuel to the passage 182 when the operator wishes to accelerate the speed of the engine 20. Preferably, the mechanism 202 includes a means for supplying fuel and a means for actuating the supply means. The means for supplying fuel comprises an accelerating pump 204 and the means for actuating comprises a operational linkage 207.

Figure 10:
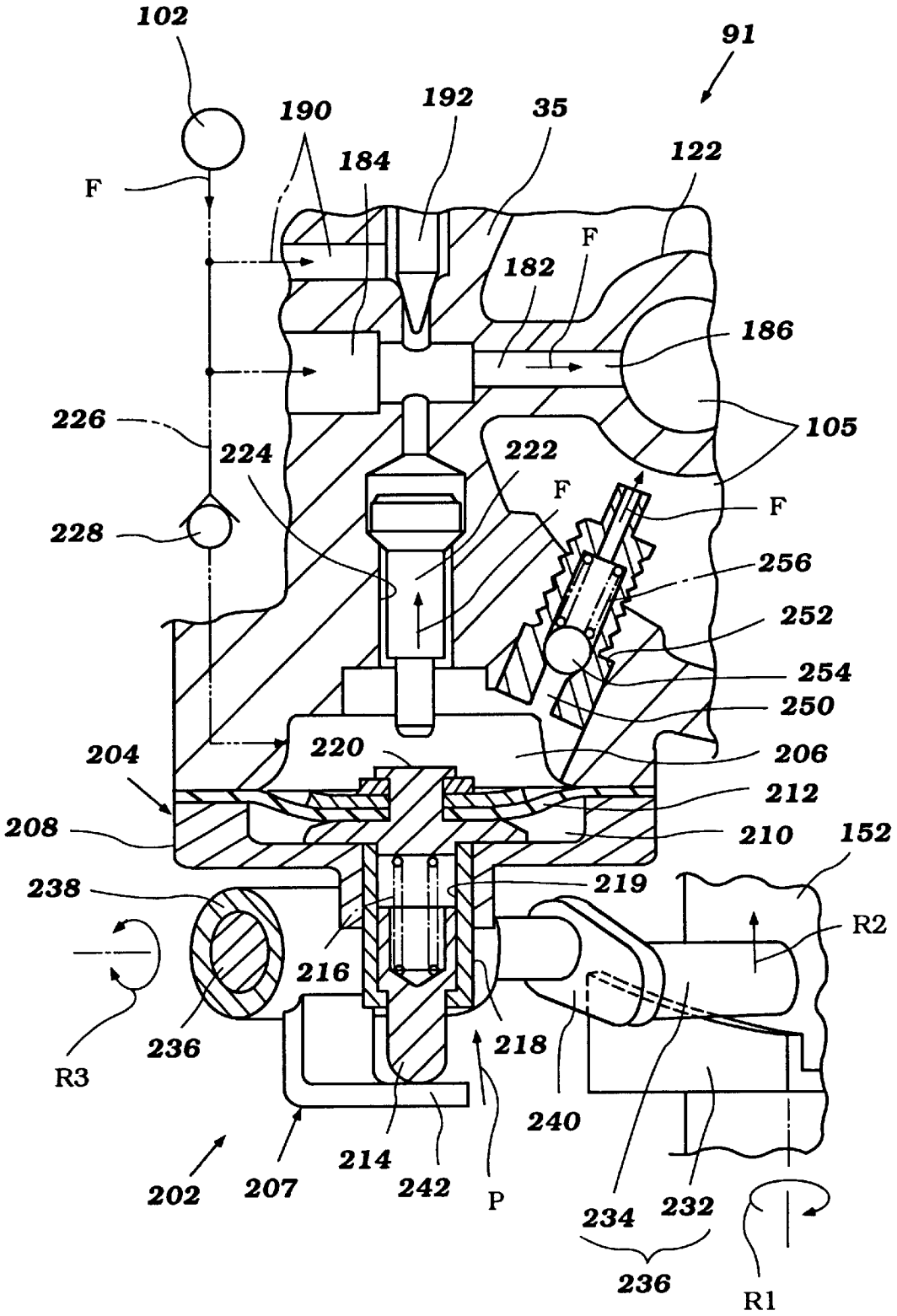
FIG. 10 is yet another cross-sectional view of the carburetor.

The pump 204 will be described primarily with reference to FIG. 10. As illustrated, the body 85 of the carburetor 91 and an attached pump housing cover 208 generally define an accelerating fuel supply chamber 206. A diaphragm 212 divides an atmospheric or air chamber 210 from the fuel chamber 206. The diaphragm 212 also provides a seal between the pump housing cover 208 and the carburetor body 85.

The pump 204 has a piston 214 which is biased in a direction away from the diaphragm 212 by a spring 216. The piston 214 translates in an axial direction along a passage 219 through a sleeve 218. The sleeve 218 extends from the housing 208. The spring 216 is positioned between the piston 214 and a plunger 220. The plunger 220 is connected to the diaphragm 212.

When the plunger 220 moves inwardly, it is arranged to engage a valve 222. The valve 222 is positioned in an accelerating fuel supply passage 224. This passage 224 leads from the accelerating fuel supply chamber 206 to the main fuel supply passage 182. Normally, the valve 222 in this passage 182 is arranged to preclude or inhibit the flow of fuel from the chamber 206 to the main passage 182.

Fuel is supplied to the chamber 206 through a supply passage 226. The supply passage, as discussed above, also leads to the delivery passage 168 (see FIG. 8). A one-way valve 228 is positioned along this passage 226 for preventing the reverse flow of fuel from the chamber 206 to towards the pump 162.

A fuel delivery path 250 also leads from the chamber 206 to the air passage 105 which extends through the carburetor 91. A pressure-activated valve 252 is desirably associated with the passage 250 to selectively open and close it. The valve 252 includes a ball 254 which is biased by a spring 256 into a position in which the ball 254 obstructs the passage 250. When the pressure within the chamber 206 becomes sufficiently high, the ball 254 compresses the spring 256 and translates within the passage 250 to a position in which fuel is allowed to flow through the passage 250. Thus, the ball 254 moves into an enlarged section of the passage 250 defined through the valve 252 and fuel flows around the ball.

The operational linkage 207 by which the pump 204 is operated will be described with reference primarily to FIGS. 7 and 10. As illustrated, a cam mechanism 230 is provided which comprises a cam surface 232 attached to the throttle valve shaft 152, and a follower element 234 which engages this surface 232.

The cam surface 232 is a sloping surface defined on an extension of the shaft 152 positioned outside of the body 85 of the carburetor 91. The follower element 234 is a cylindrical extension of a drive rod 236. As illustrated, the drive rod 236 has a first end which is rotatably attached to the carburetor body 85. The rod 236 extends at an angle therefrom towards the throttle shaft 152. Preferably, the follower element 234 is offset from the drive rod 236 by an offset member 240. Thus, the centerline through the part of the rod 236 which is supported by the carburetor body 85 is offset from the centerline through the extension portion of the rod 236 which acts as the follower element.

The drive rod 236 is coupled to a sleeve 238 having a piston engaging member 242 extending therefrom. The piston engaging member 242 is desirably an "L"-shaped member having a surface which engages an end of the piston 214 extending beyond the piston sleeve 218.

In operation, when the throttle control is moved to accelerate the engine 20, the throttle shaft 152 rotates in the direction R1 illustrated in FIG. 1. When this occurs, the follower element 234 is moved in the direction R2 as it rides along the cam surface 232. Rotation of the follower element in the direction R2 causes the sleeve 238 to rotate in the direction R3, and thus move the piston engaging member 242 and thus piston 214 in the direction P.

When the piston 214 moves inwardly, it overcomes the spring force and pushes the diaphragm 212 inwardly. If the fuel pressure becomes very high in the fuel chamber 206, some of the fuel is supplied through the passage 250 when the valve 252 opens. In this manner, additional fuel is provided to the air passing through the passage 105.

If the piston 214 is moved further inward, the plunger 220 will engage a portion of the valve 222 and open the accelerating fuel passage 224 which leads to the main passage 182. Thus extra fuel is also delivered to the engine 22 through the fuel passage 224.

In accordance with the present invention, the accelerating pump 204 is positioned on a side of the carburetor body 85 which is generally opposite the body of the engine 22, including the cylinder block 70. In fact, in this arrangement, the accelerating pump 204 faces downwardly towards the bottom 50 of the hull 26. In this manner, less heat is transmitted from the body of the engine 22 to the pump 204. Due to the lower relative temperature resulting from this positioning, the fuel supplied to the chamber 206 evaporates at a much slower rate. Accordingly, when additional fuel must be supplied to the engine 22, the fuel has not evaporated and is in the chamber 206 ready for instantaneous delivery.

In accordance with the present invention, a lubrication system is associated with the engine 22 for supplying lubricant thereto. As used herein, the term lubricant and oil are meant to be synonymous, and may include natural petroleum oil, synthetic lubricants or other materials known to those of skill in the art.

Preferably, the lubrication system is arranged so that lubricant is supplied to the engine 22 along with the fuel by the carburetor 91. As illustrated in FIG. 6, a lubricant reservoir 260 contains a predetermined quantity of lubricant L for supply to the lubricant system. This system includes a first lubricant supply 259 including a lubricant pump 262 which draws lubricant L from the reservoir 260. The lubricant pump 262 is in fluid communication with a lubricant supply conduit 264. The lubricant supply conduit 264 is desirably provided with a pressure valve, a check valve or other similar one-way type valve 268 to ensure that lubricant (and fuel, as described below) does not flow back through the conduit 264 into the pump 262. As illustrated in FIG. 6, the lubricant supply conduit 264 merges with the connecting passage 196 of the secondary or the idle fuel delivery mechanism downstream of the idler passage one-way type valve 198.

Preferably, the lubrication system includes a second lubricant supply 269, as also illustrated in FIG. 6. Importantly, the first lubricant supply 259 may be used in conjunction with or is an alternative to the following second lubricant supply 269. Similar to the first lubricant supply 259, the second lubricant supply 269 utilizes a lubricant pump 270 to provide lubricant to the fuel supply at a location external to the fuel chamber 70. A lubricant pump may be selected from any of a number of pumps generally known of those of skill in the art. In the illustrated embodiment, the lubricant pumps 262,270 are desirably driven by an output shaft of the engine 22, as described below.

The second lubricant pump 270 supplies lubricant from the lubricant reservoir 2260 to the fuel supply through a second lubricant supply conduit 274. A valve 272, similar to the valve 268 discussed above, is desirably provided within the second lubricant supply conduit 274 to prevent backflow towards the second lubricant pump 270. The second lubricant supply conduit 274 merges with the main passage 182 downstream of the main passage checkvalve 184. By providing the lubricant at a location downstream of the main passage checkvalve 184, the lubricant intake system assures that the fuel contained in the fuel chamber 170 will not be displaced by lubricant from either lubricant intake system 240, 260. The lubricant, however, is mixed with the fuel prior to the introduction of the fuel/oil mixture into the airstream (see FIG. 6).

Figures 11, 12:
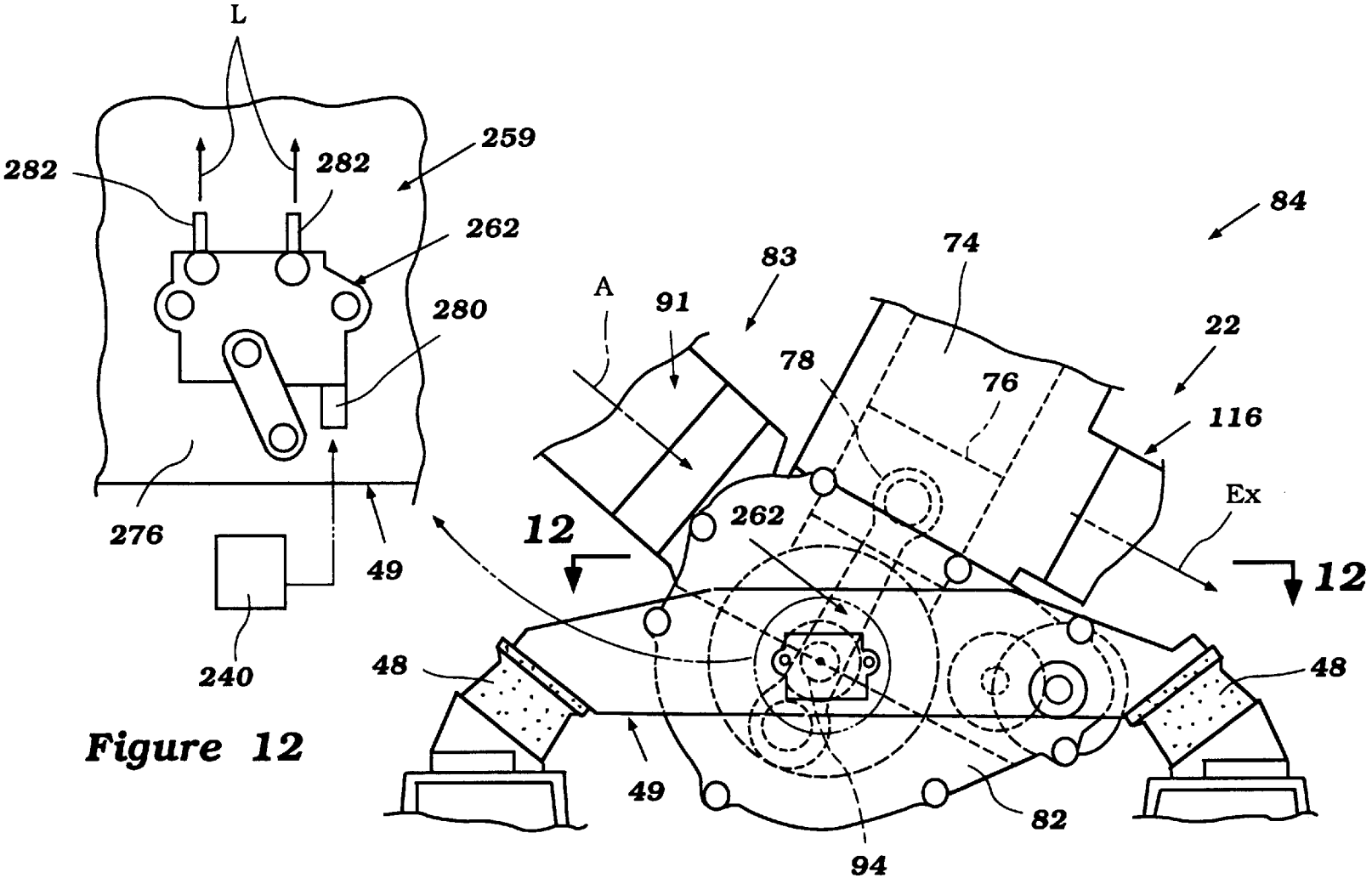
FIG. 11 is a cross-sectional front view of a portion of an engine powering a watercraft, the engine having a lubrication system arranged in accordance with an embodiment of the present invention.
FIG. 12 is an enlarged view of a lubricant pump which is mounted on the portion of the engine illustrated in FIG. 11.

With reference now to FIG. 11, a front view of an engine having a lubrication system such as that described above. While the present application may be constitute a description of either one or both of the lubricant systems 259,269 described above, FIGS. 11, 12 and 13 will be described with reference to the first system 259 including the lubricant pump 262. One skilled in the art will recognize however, that the lubricant pump 262 may be the same as or in addition to the lubricant pump 270. In other words, the lubricant pump 262 may also supply lubrication oil L to the main supply passage 182 as well as the connecting passage 196. Accordingly, any further reference to the first lubrication intake system 262 applies equally to the second lubricant supply 269.

Figure 13:
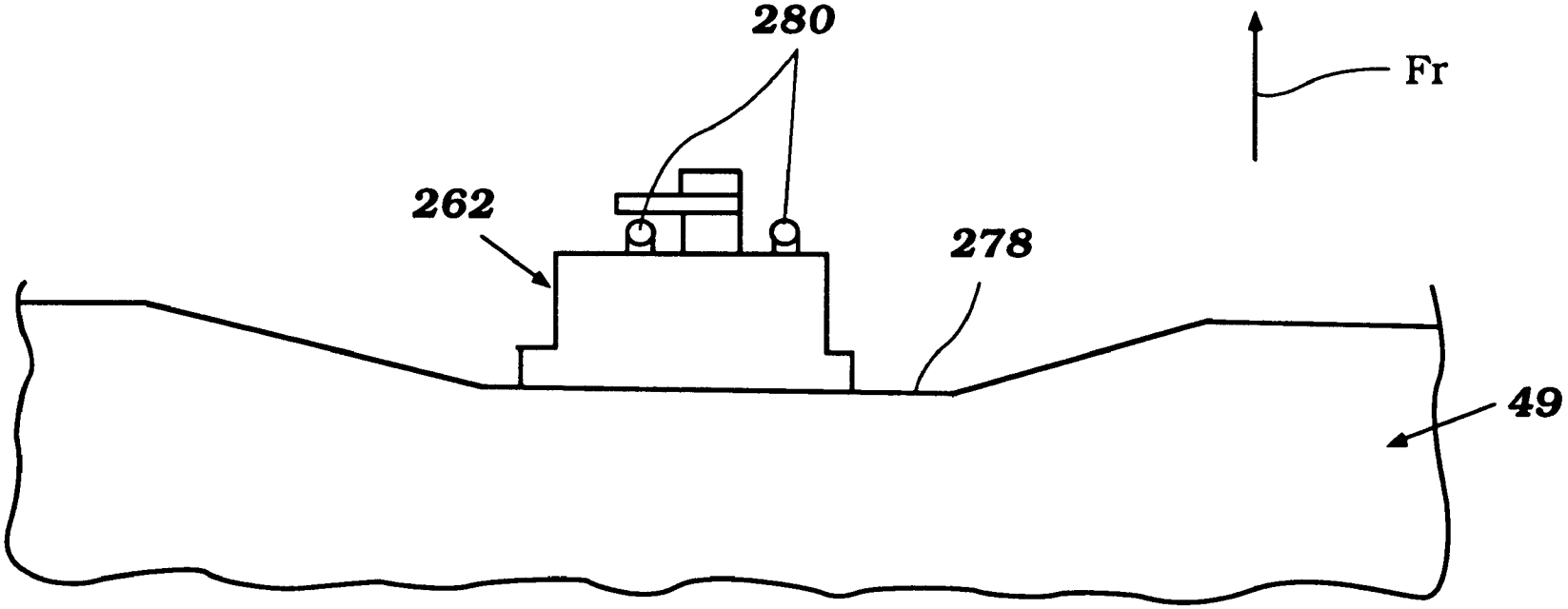
FIG. 13 is a top plan view of the lubricant pump and engine portion illustrated in FIG. 12.

As illustrated in FIG. 13, the engine mounting bracket 49 is provided with a recess 278. The lubricant pump 262 is mounted on the recessed portion 278 of the engine mounting bracket 49. As described above, the engine mounting bracket 49 is attached to a bottom portion of the hull through resilient engine mounts 48. The pump 262 is desirably mounted in a position such that it may be driven by the crankshaft 54 or by pressure pulses which occur within the crankcase 82. In addition, the pump 262 may be throttle-actuated or electrically actuated.

As illustrated in FIG. 12, the pump 262 has a suction port 280. The pump 262 is arranged to draw lubricant through the suction port 280 from the lubricant supply reservoir 242. The lubricant L is then pumped by the lubricant pump 262 through a pair of discharge ports 282. In the illustrated embodiment, two discharge ports 282 correspond to the cylinders 74 of the illustrated engine 22 (i.e. one of the ports 282 provides lubricant to one of the two carburetors 91 associated with the engine 22, there being a carburetor 91 for each cylinder 74). As will be recognized by one skilled in the art, a single discharge port 282 which supplies lubricant L to both cylinders 74 may also be used. In addition, as will also be recognized by one skilled in the art, the number of discharge ports 282 may be varied to correspond to the number of cylinders 74 present in the application.

The lubrication system of the present invention has a number of distinct advantages. First, the lubrication system provides lubricant to the engine 22. The rate at which lubricant is delivered can be controlled accurately since the lubricant is delivered into the fuel as it is delivered to the engine, and not into a large fuel tank where the relative concentration of the fuel and lubricant can not be changed quickly.

Advantageously, the lubrication system can be used with an engine 22 having a floatless carburetor 91 which delivers the fuel thereto. In particular, the lubricant delivery does not affect the operation of the carburetor 91.

As may be appreciated, the lubricant is delivered into the fuel stream downstream of the fuel chamber 170. This arrangement reduces the possibility that lubricant might fill the chamber 170, such as when the engine 22 is not running but the pressure of the lubricant in the conduits 264,274 is high. In such an instance, difficulty would be encountered because the presence of large quantities of lubricant in the chambers 170 would reduce the rate of fuel delivery. This could result in a hard engine start or engine stalling, depending on the engine condition.

Another advantage of the lubrication system is that the lubricant is delivered upstream of the throttle valve 102. In the watercraft environment, salt water tends to corrode the components of the engine 22. This corrosion may cause the throttle valve 102 to stick. In this arrangement, the valve 102 is lubricated.

Those of skill in the art will appreciate that the conduits 264,274 may comprise pipes, hoses and/or passages formed within other components of the engine, such as the body of the carburetor 91.

Of course, the foregoing description is that of preferred embodiments of the invention, and various changes and modifications may be made without departing from the spirit and scope of the invention, as defined by the appended claims.

What is claimed is:

1. A lubrication system for an engine having an intake system through which air is supplied to the engine, a carburetor associated with said intake system, said carburetor arranged to deliver fuel into air passing through an air flow passage extending therethrough, said carburetor having a fuel supply chamber and an air chamber, a diaphragm dividing said fuel supply chamber from said air chamber, said carburetor also having a main fuel supply line extending between said fuel supply chamber of the carburetor and a discharge at said air flow passage extending through said carburetor, a first one-way type valve arranged along said main fuel supply line, said air chamber coupled to an air source whereby movement of said diaphragm causes fuel to be discharged through said main fuel supply line to said air passage, said lubrication system arranged to deliver lubricant from a supply line communicating with said main fuel supply line between said first one-way type valve and said discharge.

2. The lubrication system in accordance with claim 1, wherein a throttle valve is positioned in said air passage and said discharge of said main fuel supply line is upstream of said throttle valve.

3. The lubrication system in accordance with claim 1, further comprising a lubricant pump in fluid communication with said lubricant supply and said lubricant supply line and including a second one-way type valve arranged between said lubricant pump and said main fuel supply line.

4. The lubrication system according to claim 1 further comprising a fuel pump separate from said final fuel supply chamber of said carburetor and arranged to deliver fuel to said final fuel supply chamber.

5. A lubrication system for an engine having an intake system through which air is supplied to the engine, a carburetor associated with said intake system, said carburetor arranged to deliver fuel into air passing through an air flow passage extending therethrough, said carburetor having a fuel supply chamber and an air chamber, a diaphragm dividing said fuel supply chamber from said air chamber, said carburetor also having a main fuel supply line extending between said fuel supply chamber of the carburetor and a discharge at said air flow passage extending through said carburetor, a first one-way type valve arranged along said main fuel supply line, said air chamber coupled to an air source whereby movement of said diaphragm causes fuel to be discharged through said main fuel supply line to said air passage, said lubrication system arranged to deliver lubricant from a supply line communicating with said main fuel supply line between said first one-way type valve and said discharge, and said carburetor including a secondary fuel supply line leading from said chamber to said air passage, said discharge of said main fuel supply line being upstream relative to a discharge of said secondary fuel supply line.

6. A lubrication system for an engine having an intake system including a floatless carburetor having an air flow passage extending therethrough, a throttle valve moveably positioned in said air flow passage, a main fuel supply line extending between a fuel chamber and a discharge into said air flow passage, a first one-way type valve arranged along said main fuel supply line, a secondary fuel line extending between said fuel chamber and at least one supply port, said at least one supply port communicating with the air flow passage and arranged above said throttle valve, a second one-way type valve arranged along said secondary fuel supply line, and a lubricant supply line communicating with said secondary fuel supply line between said second one-way type valve and said at least one supply port.

7. The lubrication system in accordance with claim 6, wherein said discharge of said main fuel supply line is upstream relative to said supply port of said secondary fuel supply line.

8. The lubrication in accordance with claim 6, further comprising a lubricant reservoir, a lubricant pump in fluid communication with said reservoir and said lubricant supply line, and a one-way type valve arranged between said lubricant pump and said main fuel supply line.

9. A lubrication system associated with a carburetor attached to an engine, the carburetor having an air flow passage, a throttle valve movably positioned in said air passage, a main fuel supply line extending between a fuel chamber and a discharge to said air flow passage, a first one-way type valve arranged along the main fuel supply line, a secondary fuel line extending between the fuel chamber and at least one supply port, the at least one supply port communicating with the air flow passage and arranged above the throttle valve, a second one-way type valve arranged along the secondary fuel supply line, a first lubricant supply line communicating with the main fuel supply line between the first one-way type valve and the discharge, and a second lubricant supply line communicating with the secondary fuel supply line between the second one-way type valve and the at least one supply port.

10. The lubrication system in accordance with claim 9, wherein the discharge of main fuel supply line is arranged above a discharge of the secondary fuel supply line into said air passage.

11. The lubrication system in accordance with claim 9, further comprising a lubricant reservoir, a lubricant pump in fluid communication with the reservoir and the first and second lubricant supply lines, and a third and a fourth one-way type valve arranged along the first and second lubricant supply lines.

12. The lubrication system in accordance with claim 11, wherein the lubricant pump is mounted on an engine support bracket facing away from the engine.

13. The lubrication system in accordance with claim 12, wherein the first and second lubricant pumps are arranged on an engine support bracket facing away from the engine.

14. The lubrication system in accordance with claim 9, further comprising a lubricant reservoir, a first lubricant pump in fluid communication with the reservoir and the first lubricant supply line, a third one-way type valve arranged along the first lubricant supply line, a second lubricant pump in fluid communication with the second lubricant supply line, and a fourth one-way type valve arranged along the second lubricant supply line.

15. A lubrication system for a floatless carburetor, the floatless carburetor having a fuel reservoir and an induction air passage, said fuel reservoir adapted to receive fuel from a fuel pump, a main fuel delivery line extending between said fuel reservoir and a fuel discharge positioned within said induction air passage, a secondary fuel delivery line also extending between said fuel reservoir and a fuel discharge positioned within said induction air passage, a first one-way valve positioned within said main fuel delivery line and a second one-way valve positioned within said secondary fuel delivery line, said lubrication system comprising a lubricant reservoir and at least one lubricant delivery line extending between said lubricant reservoir and at least one of said main fuel delivery line and said secondary fuel delivery line downstream of the corresponding one-way valve.

16. The lubrication system in accordance with claim 15, further comprising a second lubricant delivery line extending between said lubricant reservoir and the other one of said main fuel delivery line and said secondary fuel delivery line downstream of the corresponding one-way valve.

17. The lubrication system in accordance with claim 16, further comprising a lubricant pump positioned along one of said lubricant delivery line and said second lubricant delivery line.

18. The lubrication system in accordance with claim 17, further comprising a lubricant pump positioned along the other of said lubricant delivery line and said second lubricant delivery line.

19. The lubrication system in accordance with claim 15, further comprising a lubricant pump positioned along said lubricant delivery line.

20. A lubrication system for a floatless carburetor, the floatless carburetor capable of being positioned along an induction air passage, said carburetor including a main fuel supply passage and a secondary fuel supply passage, said main fuel supply passage having a first end in communication with said induction air passage and a second end in communication with a fuel reservoir, said secondary fuel supply passage also having a first end in communication with said induction air passage and a second end in communication with said fuel reservoir, a first one-way type valve positioned along one of said main fuel supply passage and said secondary fuel supply passage such that no fuel reservoir is situated along said one of said main fuel supply passage and said secondary fuel supply passage between said first one-way type valve and said induction air passage, and a first lubricant supply line communicating with said one of said main fuel supply passage and said secondary at a location between said first one-way type valve and said induction air passage.

21. The lubrication system of claim 20 further comprising a second one-way type valve positioned along the other of said main fuel supply passage and said secondary fuel supply passage such that no fuel reservoir is situated along said one of said main fuel supply passage and said secondary fuel supply passage between said second one-way type valve and said induction air passage and a second lubricant supply line communicating with said other of said main fuel supply passage and said secondary fuel supply passage at a location between said first one-way type valve and said induction air passage.

22. The lubrication system of claim 21, wherein a throttle valve is positioned along the induction air passage and said first end of said main fuel supply passage is upstream of said throttle valve.

23. The lubrication system of claim 21 further comprising a lubricant pump and a third one-way type valve positioned between said lubricant pump and said main fuel supply line along a lubricant supply path that includes said first lubricant supply line.

24. The lubrication system of claim 21 further comprising a lubricant pump and a third one-way type valve positioned between said lubricant pump and said secondary fuel supply line along a lubricant supply path that includes said second lubricant supply line.

25. A method of lubricating the moving parts of a floatless carburetor having an air passage, a final fuel chamber, a main fuel supply passage leading from the final fuel chamber to the air passage, the method comprising the steps of providing a supply of lubricant, delivering lubricant from said supply to said carburetor, mixing the lubricant with fuel at a location between the final fuel chamber and said air passage along said main fuel supply passage to create a lubricant-fuel mixture, and introducing the lubricant-fuel mixture into the air passage.

* * * * *